United States Patent [19]

Lachmann et al.

[11] Patent Number: 4,883,239

[45] Date of Patent: Nov. 28, 1989

[54] GUIDED ARTILLERY PROJECTILE WITH TRAJECTORY REGULATOR

[75] Inventors: Karl-Heinz Lachmann; Peter Sundermeyer, both of Lauf-Pegn.; Johann Schreier, Ruckersdorf; Albrecht Reindler, Lauf-Schonberg; Jurgen Leininger, Lauf/Pegn., all of Fed. Rep. of Germany

[73] Assignee: Diehl GmbH & Co., Nuremberg, Fed. Rep. of Germany

[21] Appl. No.: 260,882

[22] Filed: Oct. 21, 1988

[30] Foreign Application Priority Data

Nov. 13, 1987 [DE] Fed. Rep. of Germany ..... 3738580

[51] Int. Cl.[4] ..... F41G 7/22

[52] U.S. Cl. ..... 244/3.15

[58] Field of Search ..... 244/3.15, 3.21

[56] References Cited

U.S. PATENT DOCUMENTS

| | | | |
|---|---|---|---|
| 3,946,968 | 3/1976 | Stallard | 244/3.21 |
| 4,111,382 | 9/1978 | Kissinger | 244/3.15 |
| 4,277,038 | 7/1981 | Yates et al. | 244/3.15 |
| 4,606,514 | 8/1986 | Sundermeyer | 244/3.15 |
| 4,664,338 | 5/1987 | Steuer et al. | 244/3.27 |
| 4,711,412 | 12/1987 | Wallermann | 244/3.15 |
| 4,840,328 | 6/1989 | Sundermeyer | 244/3.15 |

FOREIGN PATENT DOCUMENTS

| | | | |
|---|---|---|---|
| 3524925 | 1/1987 | Fed. Rep. of Germany | 244/3.15 |
| 2180671 | 4/1987 | United Kingdom . | |

OTHER PUBLICATIONS

Isermann, Rolf; Digital Control Systems; Chapters 22–24, 1981.

Lachmann, Karl-Heinz; Parameteradaptive Regelalgorithmen für bestimmte Klassen nichtlinearer Prozesse mit eindentigen Nichtlinearitäten, pp. 28–33.

*Primary Examiner*—Charles T. Jordan

*Attorney, Agent, or Firm*—Scully, Scott, Murphy & Pressera

[57] ABSTRACT

A guided artillery projectile with a flight attitude or trajectory regulator in the autopilot of the projectile for the guidance of a transition into a gliding trajectory at the assumption of a predetermined pitch angle after the passage through the apogee of the ballistic firing trajectory.

11 Claims, 3 Drawing Sheets

11
14
15
15
16
A
19
23
13;13.1
12
e,l
to
Dta
ta
Dtv
tv
hV
p/q
V
29
nv
23
g
18
21
13.2;13
20
17

PROGRAM CONTROL
28
27
16-AUTOPILOT
U

FLIGHT REGULATOR
CONTROL UNIT
n
w+
d
s
(11)
p
i
25
31
24
26
30 ≙ hV
i=f (r,n,y)
37
32
MEMORY STORAGE
TIME-MEASURE-MENT CIRCUITS
MEASURING INSTALLATION
Dta
Dtv
e,l ≙ hV

Dtv
32
l
e
≙ hV ≙ 30
Dta

GUIDED ARTILLERY PROJECTILE WITH TRAJECTORY REGULATOR

BACKGROUND OF THE INVENTION

1. Field of the Invention

The present invention relates to a guided artillery projectile with a flight attitude or trajectory regulator in the autopilot of the projectile for the guidance of a transition into a gliding trajectory at the assumption of a predetermined pitch angle after the passage through the apogee of the ballistic firing trajectory.

2. Discussion of the Prior Art

A projectile of that type has been known from the disclosure of U.S. Pat. No. 4,606,514 or from the disclosure of German Laid-Open Patent Appln. No. 35 24 925, as a type of flight end phase-guided artillery ammunition, which is fired ballistically and, after passage through the apogee; in essence, after flying through the maximum ordinate of the almost parabolic initial or launch trajectory curve is deflected from the descending branch portion of the ballistic trajectory into an only slightly sloped gliding trajectory, from which there is then carried out the search for a target and the target acquisition.

SUMMARY OF THE INVENTION

The invention has as its object to optimize a trajectory regulator or controller which is constructed in an autopilot of obtaining and delivering a projectile of that type, in the interest of a more accurate target point, through an improved flight guidance and an increased target hitting accuracy after a transition from the ballistic firing trajectory into the gliding trajectory.

The foregoing object is inventively achieved essentially in that the projectile with respect to its trajectory regulator, is equipped with different mission-dependent parameter groupings or inputs for the regulator.

The foregoing object is predicated on the recognition that, for an aerodynamic system of the type which is encountered herein, in the interest of being able to bridge over greater distances and for good maneuverability, operation must be effected close to its technological flight stabilization limit, that by means of the regulator there can be controlled or comprehended only a relatively narrow operating range, but in no instance the broad span of different operating ranges (with respect to flight speed and dynamic pressure) in dependence upon the extremely differing starting or launch conditions (firing charge or load and elevation of weapon barrel). As a result thereof, while maintaining the structure of the regulator, there is contemplated provided different parameter inputs or group for different operating ranges, in which there is presently attainable a stable operation under a high quality of control. These different operating ranges, which lead to different levels or dimensionings for the regulator parameter inputs are in effect, required by the different altitudes at the transition from the descending branch portion of the ballistic starting trajectory curve into the gliding trajectory and in accordance with the different starting conditions of the final phase-guided projectile. In order to avoid the necessity for having to, respectively, implement any inputs manual on the projectile itself during firing (with respect to its contemplated firing conditions and thereby with respect to the expected ballistic starting trajectory), these starting conditions are subsequently determined autonomously on board the projectile, so as to deliver a switching-over criterium for the different provided units or inputs of parameters. A relatively simply determinable, but with respect to the firing conditions extremely informative, switching-over criterium is the measurement of the intervals in time from the firing to the reaching the apogee and from the apogee to the reaching of the point of transition (for leaving the ballistic trajectory), which can be obtained without relatively any kind of problems on board the projectile, and which are unambiguously associated as an actual parameter input unit with a certain starting condition (with respect to elevation and firing load or charge). The parameter input which is correlated with such an association, and which is provided, pursuant to theoretical and experimental investigations, for a transitional altitude into the gliding trajectory, is then taken over by the flight path or altitude regulator of the autopilot, and thereafter provides optimum guidance capabilities during searches for a target and target tracking from the only slightly sloped gliding flight path.

A still better correlation of the parameter input to the actual aerodynamic conditions of the control circuit-segment which is characterized by the behavior in flight of the projectile can be achieved when, for the selection of the parameter input (in addition to the conclusion over the starting conditions, or instead of this conclusion) there are obtained during flight the actual parameters of the actual transition behavior of the segment, which is determined pursuant to its structure, from a comparison of the actually encountered control signals prior to and associated actual values subsequent to the segment; possibly, in conjunction with the superposition of test signals, in the event that the disruptive environmental influences encountered at the point in time between the apogee and the point of transition should not, as a consequence, lead to control circuit magnitudes (changes in the control signal and fluctuations in the actual values) which are strongly evidentiary for the process model-identification.

The thusly actually estimated parameters of the transitional behavior of the segment; in effect, the process model, represent the significant aerodynamic influencing magnitudes acting on the projectile which are dependent upon the instantaneous flight surroundings; especially such a the momentary velocity of the projectile and the surrounding air density, predicated on the known aerodynamic-physical principles. Thus, also these informations can again characterize the actual, above-defined operating range of the trajectory regulator and, as a consequence, be utilized for the prescription of actual valid regulator or controller parameters. For this purpose, from that actual estimated process model, there can be determined during the flight, and thereby in real-time, the associated regulator parameters with regard to a regulator design criterium which is intended for the system (computer program or specification).

However, inasmuch as the actual parameters of the travel path or segment-transitional behavior were determined from environmentally-required or test conclusions, with omitting of the aero-physical model computations, there can also be directly obtained an association with one of a plurality of provided parameter inputs or groups for the future operation of the trajectory regulator; namely, with that particular parameter input which, due to theoretical or experimental preliminary investigations promises the widest range of a stable operating mode of the trajectory regulator for these environmental conditions; resulting from the actual firing conditions.

Instead of only a single prescription of an optimized parameter input for the guidance of the projectile into the gliding flight path, from the behavior of the trajectory regulator, in principle in the same manner as previously described, from then on there can be repeatedly drawn conclusions over the actual operating conditions, and therefrom carried out a correction of the effective regulator parameter input, such that by means of adaptations of the parameter inputs, there will be constantly assured a widest possible stable operating range for the flight path regulator.

In the construction of the trajectory or fight path regulator, and thereby in the determination of its alternatively effective parameter inputs or units, there is preferably considered that the regulator is expediently designed as a multi-level or polynomial regulator, whereby reciprocal cross-couplings are present between the control magnitudes (especially such as the pitch actuation and role actuation in order to produce a yaw movement) due to the given aerodynamic principles. These can be extensively compensated for, when a correlated equalization network is connected in parallel with the regulator, in order to possibly compensate from the start the coupling influences from the one segment to the segment in another control circuit through a corresponding opposite actuation of the other regulator. The same design criteria also finds application for correlated, operationally-dependent switchable parameter inputs in a rated-value transmitter, which converts the target tracking information obtained by the search head of the projectile into reference or rated values for the coupled multi-level regulation of the trajectory.

BRIEF DESCRIPTION OF THE DRAWINGS

Additional alternatives and modifications, as well as further features and advantages of the invention can now be readily ascertained from the following detailed description of the preferred exemplary embodiments, taken in conjunction with the accompanying drawings; in which.

DETAILED DESCRIPTION

Figure 1:
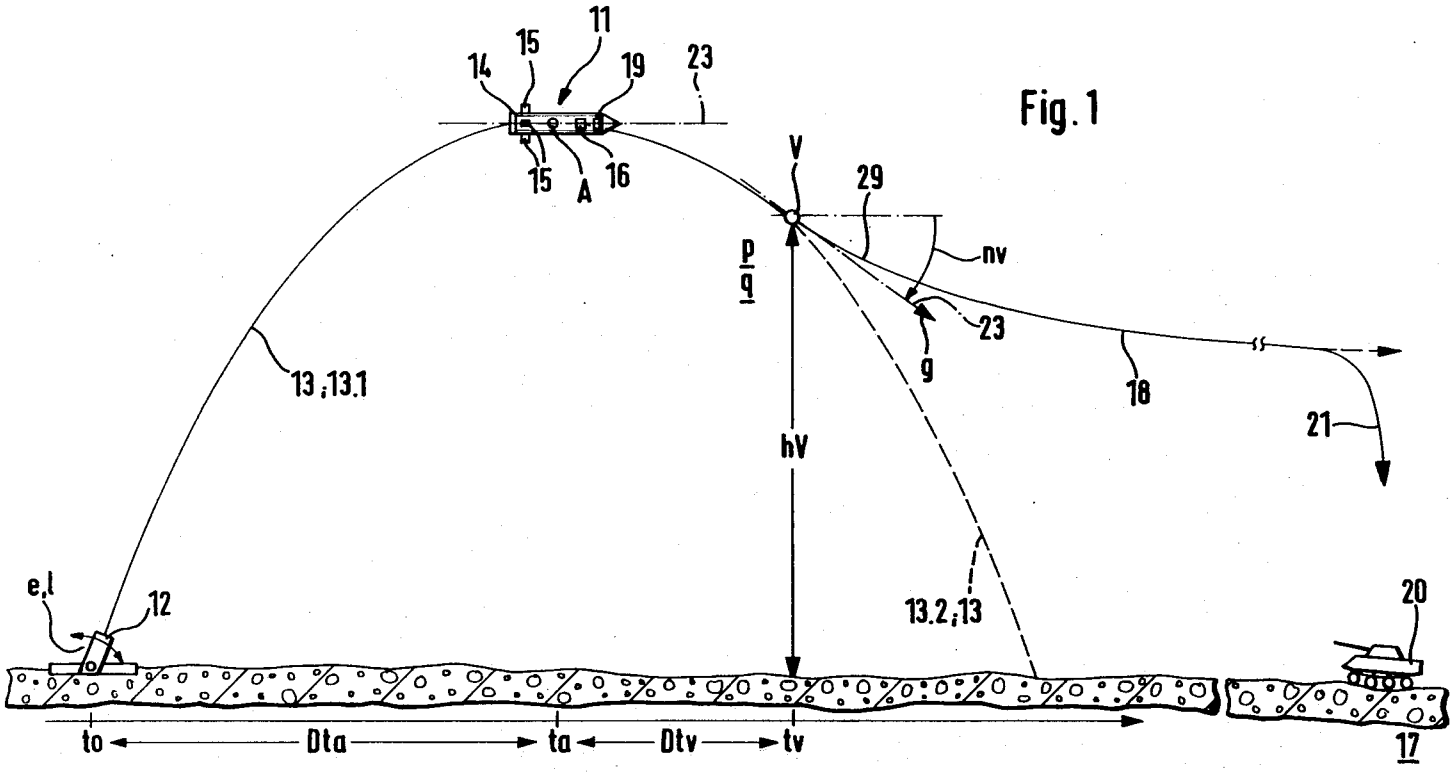
FIG. 1 illustrates a diagrammatic layout of the qualitative representation of a ballistic firing trajectory with transition into a slightly sloped quasi-linear gliding path, from which there is acquired a target which is to be attacked.

An artillery projectile 11 is fired in a ballistic trajectory 13 through the utilization of a weapon barrel 12. The resultingly encountered spin is attenuated along the ascending curve of flight 13.1 through suitable actuation of control surfaces 15, which are swung outwardly beyond the outer jacket surface of the projectile 11 after exiting from the weapon barrel 12, and for the remainder are actuated by an autopilot 16 on board the projectile 11 in conformance with the principles of the ballistic trajectory 13.

The spatial orientation of the weapon barrel 12 during firing is effected in accordance with the measure of the intended delivery of the projectile 11 over a previously detected target area 17.

In the interest of attaining a greater range towards a target area and good searching capabilities for a target, the projectile 11 leaves the descending branch segment 13.2 of the initial ballistic trajectory 13 by a transition into a relatively slightly sloped gliding trajectory 18. From this trajectory, by means of a search head 19 located on board the projectile 11, the target area 17 is scanned for a target 20 which is to be attacked. Upon the detection of a target, the search head 19 steers the projectile 11 into a steeply descending attacking path of flight 21 in order to cause the target to be set out of action.

At the peak point or maximum ordinate of the initial ballistic trajectory 13, hereinafter generally designated as the apogee A, the longitudinal axis 23 of the projectile 11, which in the interim has been roll-stabilized, has assumed a good approach to a horizontal position, which is absorbed by the autopilot 16 as a spatial reference orientation (pitch angle=0°). The reaching of the apogee timepoint ta after the firing timepoint to can be determined autonomously on board the projectile 11, somewhat such as through evaluation of measured altitude or dynamic pressure changes (referring to U.S. Pat. No. 4,606,514 or U.S. Pat. No. 4,840,328); however, the apogee timepoint ta can be determined from a trajectory computation with the aid of the information delivered by the flight regulator or controller of the autopilot 16 (referring to U.S. patent application Ser. No. 191,588 filed May 9, 1988).

When the projectile 11, after passage through the apogee; in effect, along the descending branch segment 13.2 of the ballistic trajectory 13, assumes a pregiven pitch angle nv at the timepoint tv, then by means of the autopilot 16 there is carried out a changeover from the ballistic descending trajectory 13.2 into the gliding trajectory 18 through the outward extension of glide wings (not shown in the drawings; referring to U.S. Pat. No. 4,664,338 or German OS No. 35 24 925) in order to improve upon the aerodynamic guidance capability and the gliding-flight characteristics.

The altitude of the point V of the trajectory at which there is an exit from the ballistic descending curve segment 13.2, is accordingly dependent upon the altitude at which there is reached the apogee A. The altitude of the apogee, in turn, is again dependent upon the elevation of the firing weapon barrel 12 and upon the firing velocity; in essence, upon the sizing of the propellent charge, (the socalled load number) for the acceleration of the projectile 11 to be fired in the weapon barrel 12.

Inasmuch as, under conditions of combat, the elevation and load number can be extremely differingly selected, the trajectory point altitude Hv can also fluctuate within extremely wide bounds. Correspondingly fluctuating, in dependence upon the firing conditions, are the aerodynamic environmental conditions, especially such as the velocity g and the atmospheric air-pressure p upon reaching of the deflecting-trajectory point V.

Due to the deployment and payload conditions for a projectile 11 of the type which is considered herein, this represents an aerodynamic system which must be operated in close proximity to its limit in stability; in essence, which allows for the sizing of the flight regulator in the autopilot 16 only a narrow operating range; outside of this intended operating range, the accuracy in the regulation or control is poor and as a result, the aerodynamic system thereby becomes easily unstable. As a consequence thereof, the flight regulator can be designed only for certain relatively narrow band-widths about a nominal operating range, which is obtained through the flight specifications for the gliding trajectory 18 (above all velocity and dynamic pressure) and thereby to the greatest extent through the altitude Hv of the trajectory transition point V from the ballistic descending curve segment 13.2. For the different kinds of firing conditions with respect to elevation e and load number 1, and thereby for different actual transition altitudes hV, there must be pregiven different regulator dimensionings; in essence, different regulator parameter inputs for the same regulator or controller structure. These tasks can basically be carried out during firing in accordance with the measure of the predicted firing conditions; however, which due to battle conditions would be considerably susceptible to errors. Instead thereof, an autonomous switching-over of the regulator or controller parameter inputs is carried out on board the projectile 11 in accordance with the measure of the firing conditions, as is shown symbolically simplified in FIG. 2. Therein, for a simplification of the representation of the aerodynamic-physically required behavior of the projectile 11, this is itself considered within the autopilot 16 as a control segment 24, which in conformance with the extent of the control deviation d (difference between the rated value w and actual value i), can be controlled with control signals s from the flight regulator 25. Measuring installations 26 on board the projectile 11 determine the actual flight values i resulting from this actuation.

Figure 2:
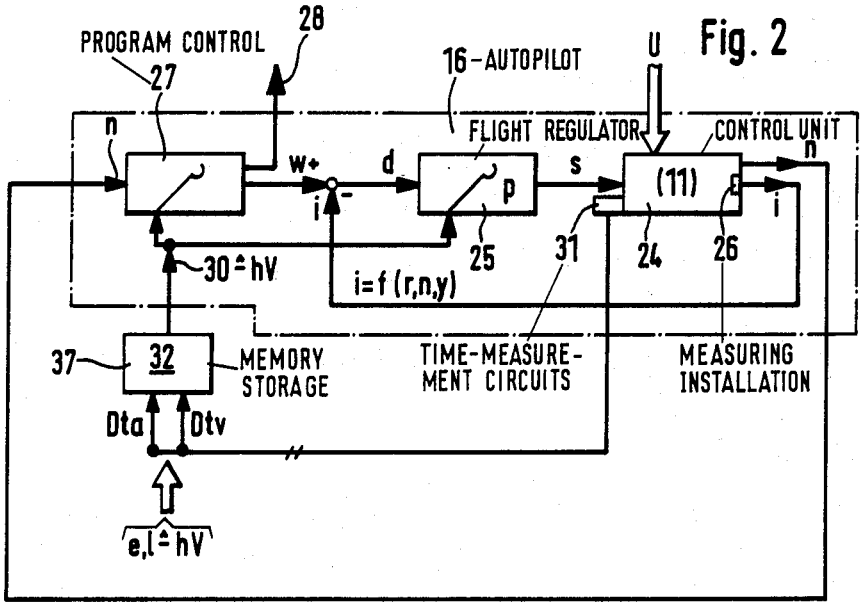
FIG. 2 illustrates, on the basis of a circuit block diagram-control circuit representation, the principal influencing possibilities for the preparedness of mission-required switchable parameter inputs for the optimum behavior of the flight path regulation prior to and subsequent of the transition from the ballistic descending trajectory into the gliding trajectory.

The behavior of the regulator 25; in effect its parameter input p, is switched over in dependence upon the altitude of the transition hV. In FIG. 2 there is also concurrently provided for a switching over of the program control 27, which upon reaching of the pregiven negative transition pitch angle nV delivers not only the wing-extension command 28, but especially also in dependence upon the transition altitude hV, the flight reference values w for an altitude-dependent transitional trajectory 29 up to reaching of the stable gliding trajectory 18.

In order to obtain an altitude-dependent selection criterium 30, time-measurement circuits 31 can be provided on board the projectile 11 which, on the one hand, measure the time period Dta from the timepoint t of the firing acceleration to the timepoint ta of the reaching of the apogee A and, on the other hand, measure at time period Dtg from the apogee timepoint to the time period tv of the reaching of the transition-pitch angle nV.

Figure 3:
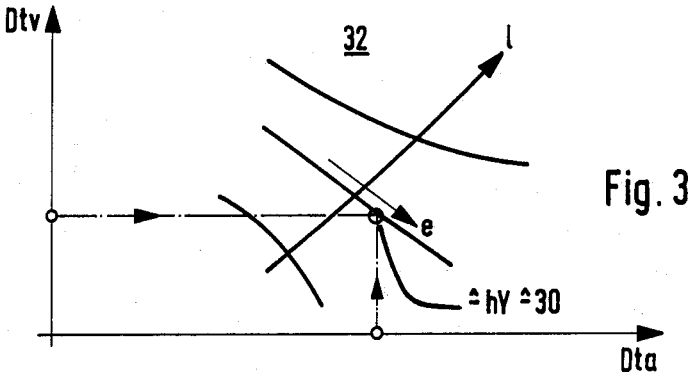
FIG. 3 illustrates, in a qualitative representation, the dependence of the period of time from the passage through the apogee up to the point in time of the transition from the ballistic descending trajectory into the gliding trajectory, graphically plotted over the period of time between the firing and the point in time of the passage through the apogee for different angles of firing elevation at different firing charges given as the parameters.

Hereby, it has been surprisingly ascertained, referring to FIG. 3, that just for these coordinates of a family or group of curves for the different weapon barrel-angles of elevation e and the different firing load numbers 1, these provide clear associations in regard therewith. This group of curves is determinable for the projectile 11 by computation, or still simpler experimentally, and can be stored in a characteristics memory storage 32. From the autonomous onboard measurement of the two time periods D, this memory storage 32 (pursuant to the extent of FIG. 3) then delivers the selection criterium 30 for the firing-dependent and thereby altitude-dependent setting of the regulator-parameter input p and, when required, also the program control 27.

Thereby, for every flight-operating range; in essence, for every firing-required transitional altitude hH, is the autopilot 16 operable with an optimally-stable flight regulator 25, which possesses a high degree of accuracy in regulation over the entire operating range; in effect, which guarantees a good regulating behavior with respect to all tolerances which are to be expected within this operating range.

Figure 4:
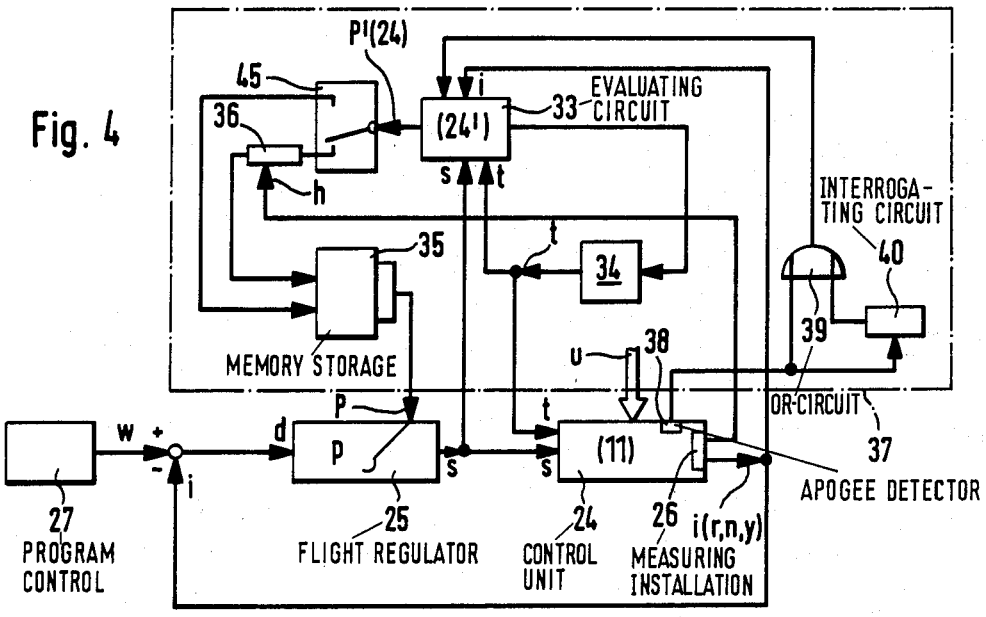
FIG. 4 illustrates, in conjunction with the circuit block diagram pursuant to FIG. 2, different possibilities of an optimization adaptively obtained from the actual conditions of flight of a parameter input group which is actually effective for the trajectory regulator.

A still further enhanced accuracy in regulation then for a selection of a pregiven parameter input pursuant to the extent of an indirect autonomous onboard transitional-altitude determination is obtained when during the course of a model estimation which is known in the control technology (referring, for example, to K. H. Lachmann, "Parametheradaptive Regelalgorithmen fur bestimmte Klassen nichtlinearer Prozesse mit eindeutigen Nichtliniaritaten" (Chapt. 4: Rekursive Parameterschatzung im parameter-adaptiven Regelkreis) VDI-Verlag, Fortschrittsberichte Reihe 8/66, 1983; or R. Isermann "Prozessidentifikation", Springer Verlag, 1974) there is undertaken a correlation of the actual regulator-parameter input p with the actual (primarily, even when not exclusively, dependent upon the transitional altitude hV) flight conditions (FIG. 4). In order to implement this measure, there can be basically carried out either a correlation of estimated model parameters with previously determined operationally-dependent parameter ranges; or, however, on board the projectile 11 the determination of the momentary velocity thereof and the surrounding air density from a pregiven estimated model parameters and the known aerodynamic/physical relationships for the behavior of this projectile 11.

Up to the point of transition V from out of the ballistic descending trajectory 13.2, there is effected the stabilization of the projectile 11 by means of a simple, fixedly set ballistic regulator or controller as a deliverer for a control magnitude in the autopilot 16. When the glide wings are to be extended, in the interest of obtaining a good trajectory guidance for a precise delivery to a target area, there must become active gliding flight attitude regulators of an increased accuracy, and thereby as previously mentioned, mission-dependently optimized regulator parameter inputs P, without necessitating that through the parameter changeover, anything must be changed on the actual structure of the regulator 25, which is already optimized with regard to the dynamic behavior of the actually present projectile 11. For the selection of the actually significant parameter input p which is dependent upon the actual mission; in essence, upon the transitional altitude hV, pursuant to the modified embodiment of FIG. 4, there is carried out an evaluation of the actual behavior in flight between the apogee timepoint ta and the transition time point tv. The identification of the actual operating range can be obtained directly from the disruptive influences which are encountered subsequent to the apogee A, in that the control signals S which are delivered from the still ballistically adjusted regulator for the blocking out of environmental disruptive influences, are received in an evaluating circuit 33 for a comparison with the actual condition-values i. Should the control signals S which are actually available after the apogee A be not sufficiently distinct for evaluation, then the evaluating circuit 33 signals a test emitter 34 for the emission of at least one test signal T of a suitable type and of sufficient intensity for the observation of the transitional behavior of the actual values i. Pursuant to the structure specifications for the actually active regulator 25, the evaluating circuit 33, on the basis of the measured transitional behavior with respect to roll motion r, pitch motion n, and yaw motion y of the projectile 11, determines the corresponding parameter input P' of the given model 24' of the segment 24.

Through a selector switch 45 in FIG. 4 there is symbolically indicated that, by means of this parameter input P', there can be selectively directly selected a previously associated of different possible operating parameter inputs P from a parameter memory storage 35 for the change-over into the transitional trajectory 29; or; however, for the momentarily given altitude of flight h, the surrounding air density q and the momentary projectile velocity g act on the ballistically descending curve segment 13.2 pursuant to the measure of the prior known physical-aerodynamic behavior of the projectile 11 is obtained from a mathematical model representation 36, in order to thereafter discharge from the parameter storage 35 the parameter input P which is optimized to the actual conditions for the switching-over of the regulator or controller 25 from the ballistic trajectory 13 to the transitional glide trajectory curve 29, 18 from the parameter memory storage 35. In this storage 35 there are tabularly set up the parameter inputs P which are optimized for the possible individual mission-required regulator-operating ranges, with consideration given to the conditions with respect to projectile velocity g and surrounding air density q, as well as consideration to the parameter model for the aerodynamic behavior of the projectile.

The function of this parameter selector circuit 37 which is supplied from the flight regulator 25 is; in effect, initiated from an apogee detector 38 after passage through the apogee A. As is indicated by the OR-circuit 39 in FIG. 4, this procedure in parameter optimization can thereafter also be repeatedly triggered by means of a then actuated interrogating circuit 40, in order to achieve, even after swinging into the gliding trajectory 18, a discontinuous or even quasi-continuous correlation of the actual regulator-parameter input P pursuant to the extent of varying operating conditions; in effect pursuant to the extent of the actual behavior in flight in comparison with a model of the segment 24 obtained in the control technology.

Figure 5:
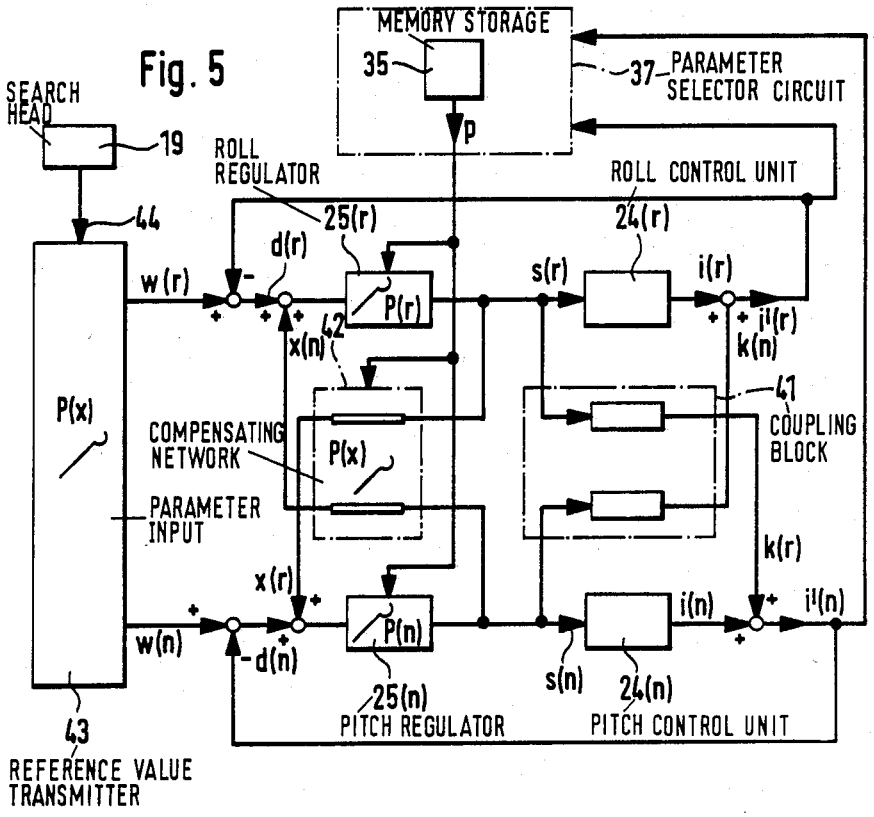
FIG. 5 illustrates, in a detail of the representations to FIG. 2 or FIGS. 4, the trajectory regulator as a coupled multi-level controller.

The restricted storage space which is available within the structure of projectile 11 for the not yet extended wings prohibits for the yaw control (in effect, for the determination of the direction of flight in space) the provision of additional larger aerodynamically-effective surfaces, transverse of the plane of the glide wings acting in the pitch direction. As a result thereof, the yaw maneuver for homing against a target 20 detected at an angle forwardly thereof, will not be carried out directly from the momentary path of movement, but must be implemented through the superposition of a roll motion r and a pitch motion n (referring to German OS No. 35 24 925). It is known (from the disclosure of U.S. Pat. No. 3,946,968) that these two maneuvers cannot be carried out independently of each other, inasmuch as due to the aerodynamic principles, there are encountered intense cross-couplings; in effect, one of the two maneuvers will also produce effects over the behavior in flight (and conversely) which is associated with the other maneuver. These system-required aerodynamic dependencies are illustrated in FIG. 5 as the coupling block 41. This block produces in a multi-parameter regulating or control system (in this instance, for the roll angle r or in essence the roll rate, and for the pitch angle n, or in essence, the pitch rate) that, for example, for a changed roll-reference value w(r), notwithstanding the maintained pitch-reference value w(n), the setting signal s(r) which is delivered by the roll regulator 25(*r*) superimposes in the pitch channel on the given actual pitch value i(n) a roll-dependent coupling influence k(r) to a modified, resultant actual pitch value i'(n); such that the pitch regulator 25(*n*) must now become active, although on the side of the pitch reference value w(n) n change of any kind is encountered. As a consequence thereof, such couplings cause the danger in the presence of poor or unstably operating control circuits.

In order to compensate for the effect of the coupling block 41, from the setting or control signal s of the actually addressed regulator 25; in the present example, in essence from the roll controlling signal s(r), there is obtained a compensating information x through cross-coupling compensating network 42 which is connected in parallel with the regulator 25, and is superimposed on the actual control deviation d ahead of the regulator 25 in another channel The physical behavior; in effect, the mathematical model of the compensating network 42, is for this purpose essentially complementary t the behavior of the coupling block 41. Inasmuch as the aerodynamic behavior thereof again, in turn, depends upon the momentary condition of flight, compensating network 42 has associated therewith, in an advantageous manner, for a time-optimized stable flight attitude control, as is described hereinabove with respect to the regulator 25, the parameter input P(x) which is selected as to be optimally mission-dependent, and if required, influencable over the course of time.

The applicable measure can also be expediently met in a reference value transmitter 43 which, in conformance with the extent of the target-offset information 44 delivered by the search head 19, with consideration to the pregiven guidance principles, delivers the reference values w for the homing onto a target to the multi-level regulator 25, which through mission-dependent correlated parameter inputs P(x) for preliminary consideration of the given couplings, lead to optimized reference values w in the sense of a stable regulator or controller operating manner.

What is claimed is:

1. A guided artillery projectile with an autopilot, a flight attitude regulator in said autopilot for the transitional guidance into a gliding trajectory upon the assumption of a predetermined pitch angle after passage through the apogee of a ballistic firing trajectory; and different mission-dependent parameter inputs being provided for the regulator.

2. A projectile as claimed in claim 1, wherein a task for a parameter is effected on board said projectile in indirect dependence upon the actual firing elevation and firing charge for said projectile.

3. A projectile as claimed in claim 1, wherein an optimized parameter input of defined selection criterium is readable out of a characteristics memory storage for the transition time period in dependence upon the apogee time period.

4. A projectile as claimed in claim 1, wherein there is a selection of the parameter inputs in dependence upon the altitude of the transition between trajectories.

5. A projectile as claimed in claim 1, wherein there is an estimation of the actual optimum parameter input pursuant to the measure of a model of a control segment and the actual regulator or disruptive magnitude indication therein.

6. A projectile as claimed in claim 5, wherein the actual optimized parameter input is obtained from a characteristics memory storage for the dependence of the actual flight velocity and dynamic pressure conditions about the surroundings of the projectile, which are defined by the actual flight segment model parameters.

7. A projectile as claimed in claim 5, wherein for the actually determined parameter input of the flight segment model there is determined on board the projectile the associated optimized regulator parameter input for a pregiven structure of the regulator.

8. A projectile as claimed in claims 5, wherein the determination of the actual model-parameter input is repeatedly implemented during the gliding flight for correlation by the regulator-parameter input.

9. A projectile as claimed in claim 1, wherein the regulator comprises a coupled multi-magnitude regulator with a compensating network connected in parallel with the regulator.

10. A projectile as claimed in claim 9, wherein there is provided an adaptive optimization of parameter input for the compensating network.

11. A projectile as claimed in claim 10, wherein the design criteria for the parameter input optimization of the compensating network is considered also during the sizing of a multi-magnitude reference value-transmitter which is arranged between a projectile search head and said flight attitude regulator.

* * * * *